US006082435A

United States Patent [19]

Suzuki et al.

[11] Patent Number: 6,082,435

[45] Date of Patent: Jul. 4, 2000

[54] METHOD OF QUALITY CONTROL OF DIE CASTING PRODUCT AND DIE CASTING MACHINE CONTROLLING APPARATUS

[75] Inventors: Kenichi Suzuki, Fuji; Yukio Mizota, Numazu, both of Japan

[73] Assignee: Toshiba KiKai Kabushiki Kaisha, Tokyo-to, Japan

[21] Appl. No.: 08/979,701

[22] Filed: Nov. 26, 1997

[30] Foreign Application Priority Data

Nov. 27, 1996 [JP] Japan ..... 8-316076

[51] Int. Cl.[7] ..... B22D 46/00; B22D 11/16

[52] U.S. Cl. ..... 164/4.1; 164/452; 164/154.8

[58] Field of Search ..... 164/4.1, 452, 154.1, 164/154.8

[56] References Cited

U.S. PATENT DOCUMENTS 5,388,629 2/1995 Kami ..... 164/154.1
5,527,377 6/1996 Miwa et al. ..... 164/452
5,854,749 12/1998 Kellams et al. ..... 164/452

FOREIGN PATENT DOCUMENTS 59-206150 11/1984 Japan ..... 164/452
61-276760 12/1986 Japan ..... 164/154.8

*Primary Examiner*—Harold Pyon
*Assistant Examiner*—I.-H. Lin
*Attorney, Agent, or Firm*—Pillsbury, Madison & Sutro, LLP

[57] ABSTRACT

A method of quality control of a die casting product, which method is capable of judging the quality in real time at a higher accuracy and updating and managing good quality product data for judging the higher quality thereof, includes a step of reading in measured data obtained as a result of a predetermined measurement with respect to the product cast by the die assembly in use together with the casting condition data, a step of sequentially accumulating the read measured data and casting condition data up to a predetermined capacity and performing a comparison display of the measured data combined with good quality product data to be used for judging a quality of the product, a step of repeating, if the comparatively displayed measured data are higher in quality than the present good quality product data, the above steps, then setting the accumulated measured data as a new good quality product data and updating the present good quality product data and the present casting condition data together with the above casting condition data, and a step of storing and holding the updated good quality product data and the updated casting condition data.

1 Claim, 2 Drawing Sheets

METHOD OF QUALITY CONTROL OF DIE CASTING PRODUCT AND DIE CASTING MACHINE CONTROLLING APPARATUS

BACKGROUND OF THE INVENTION

The present invention relates generally to a method of quality control of a die casting product and a die casting machine controlling apparatus and, more particularly, to a method of quality control of a die casting product and a die casting machine controlling apparatus for executing the quality control method, which perform a quality control based on a comparison between good quality product data and real time measured data when the die casting machine operates, and a management of the good quality product data when casting a good quality product in the die casting machine controlling apparatus.

A casting engineer has hitherto visually judged whether or not a casting product has a good quality and is, i.e., good enough to meet predetermined standards in the casting process by die casting.

On the other hand, there has been utilized a system for monitoring a state of an already-casted product by use of waveform data and nemeric quality monitoring data, etc.

As explained above, however, the quality judgement is made visually by the casting engineer and has a given a limit in terms of its precision.

Furthermore, the measured data about the already-casted product are recordable. It is, however, impossible to recognize in which state the product is being now casted.

SUMMARY OF THE INVENTION

It is an object of the present invention, which was contrived in view of the problems given above, to provide a die casting product quality control method and a die casting machine controlling apparatus that are capable of judging the quality thereof in real time at a higher accuracy, and updating and managing good quality product data for judging a higher quality thereof.

According to one aspect of the present invention, there is provided a method of quality control of a die casting product, having:

a first step of controlling a die casting machine by a control signal containing casting condition data for setting a condition on the occasion of casting the product with respect to a die assembly to be used, and thus casting the product;

a second step of reading in measured data obtained as a result of a predetermined measurement with respect to the product casted by said die assembly, together with the casting condition data;

a third step of sequentially accumulating the read measured data and casting condition data up to a predetermined capacity, and performing a comparison display of the measured data combined with good quality product data to be used for judging a quality of the product;

a fourth step of, if the comparatively displayed measured data are higher in quality than the present good quality product data, repeating said first through third steps, setting the accumulated measured data as a new good quality product data, and updating the present good quality product data and the present casting condition data together with the above casting condition data; and a fifth step of storing and holding the updated good quality product data and the updated casting condition data.

According to another aspect of the present invention, there is provided a die casting machine controlling apparatus having:

a control unit for controlling a die casting machine by a control signal containing casting condition data for setting a condition on the occasion of casting the product with respect to a die assembly to be used, and thus casting the product;

a measuring unit for reading in measured data obtained as a result of a predetermined measurement with respect to the product casted by said die assembly, together with the casting condition data, and outputting the measured data and the casting condition data;

an internal memory for sequentially accumulating the measured data and the casting condition data up to a predetermined capacity which data have been outputted from said measuring unit, outputting the measured data combined with good quality product data to be used for judging the quality of the product, besides setting the accumulated measured data as a new good quality product data, and updating the present good quality product data and the present casting condition data together with the above casting condition data;

a display unit for performing the comparison display between the measured data and the good quality product data which have been combined with each other and outputted from said internal memory;

a man-machine control unit for generating a good quality product data updating determination input if the comparatively displayed measured data are higher in quality than the present good quality product data defined as an object for comparison; and storing means for storing and holding the updated good quality product data and the updated casting condition data.

The die casting product quality controlling method and the die casting machine controlling apparatus according to the present invention, are constructed so that real time measured data during an operation of a die casting machine is compared with good quality product data in the die casting by each die assembly. Hence, it is feasible to confirm in real time whether or not casting condition data meet a condition capable of casing a good quality product in consideration of a difference between conditions of an environment etc when the die casting machine operates.

The real time measured data is compared with the good quality product data on the basis of a visual recognition using analog data and a numerical recognition using digital data.

The good quality product data corresponding to each of casting condition data are always changeable, and hence, when a higher quality product is casted, the good quality product data is immediately updated.

The updated good quality product is retained in a storage holding device as well as in an internal memory, and are therefore easily usable according to applications thereof.

The good quality product data stored and held therein are written and read together with the casting condition data at all times, and hence a misconception about a data corresponding relationship never happens.

DETAILED DESCRIPTION OF THE PREFERRED EMBODIMENTS

Embodiments of a method of quality control of a die casting product and of a die casting machine controller according to the present invention, will hereafter be described with reference to the drawings.

Figure 1:
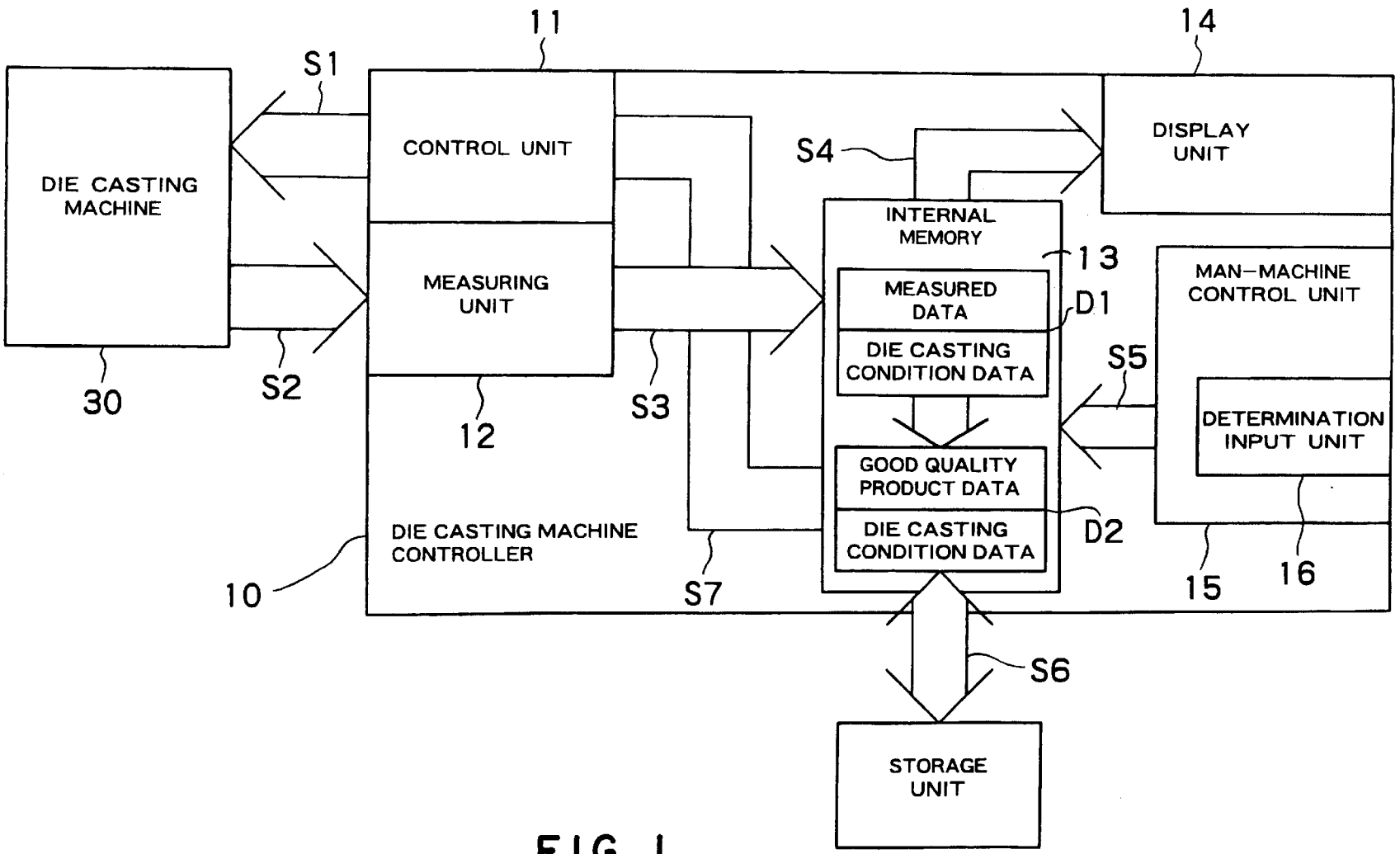
FIG. 1 is an explanatory diagram showing a construction of one embodiment of a die casting machine controller according to the present invention.
Figure 2:
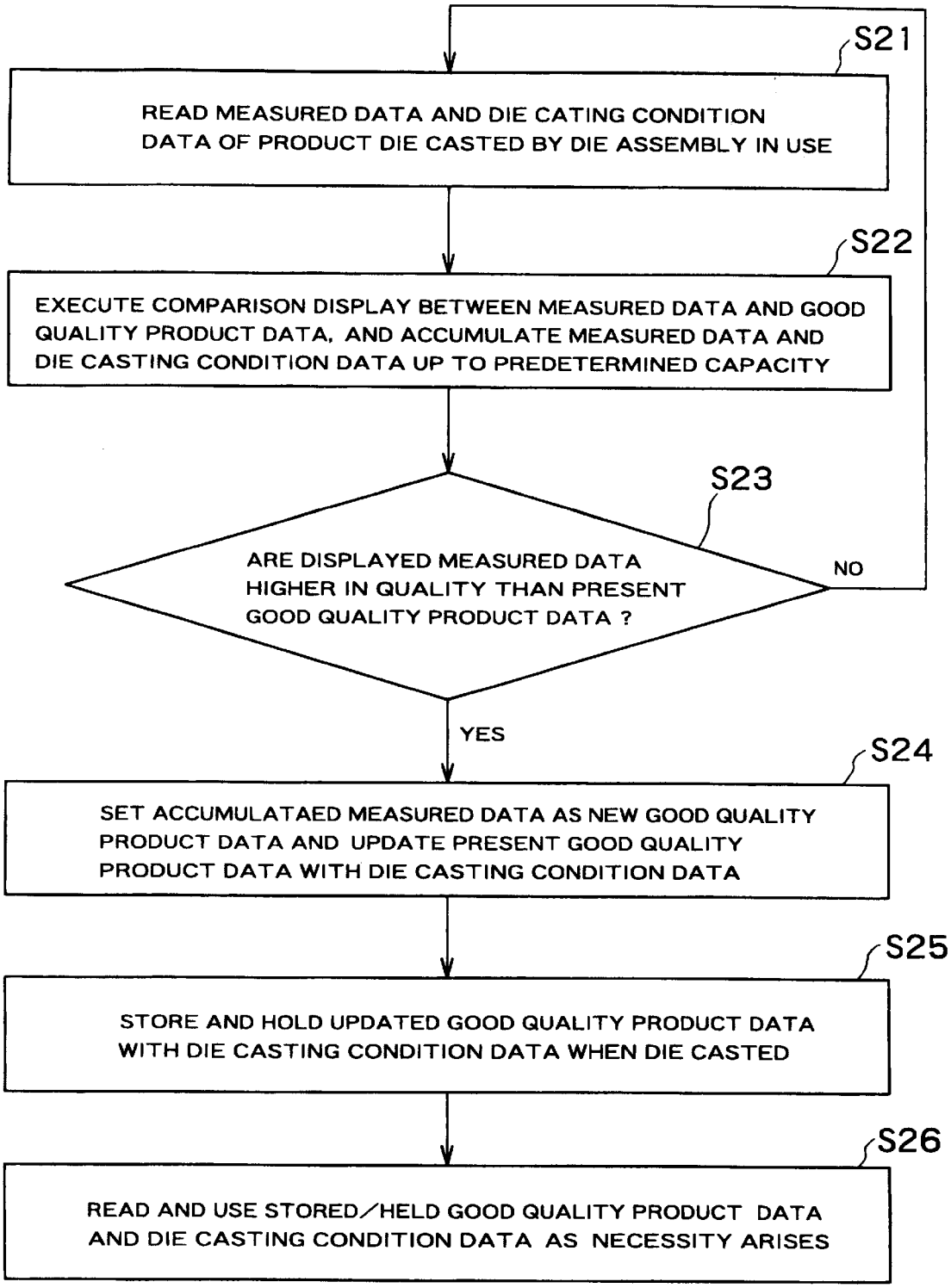
FIG. 2 is a flowchart showing one embodiment of a die casting product quality control method according to the present invention.

FIG. 1 is an explanatory diagram showing a construction of one embodiment a die casting machine controller according to the present invention. FIG. 2 is a flowchart showing one embodiment of the method of the quality control of the die cast product according to the present invention.

A die casting machine controller 10 according to the present invention comprises, as illustrated in FIG. 1, a control unit 11 for controlling a die casting machine 30 by a control signal for containing casting condition data for setting, for a die assembly to be used, conditions in the case of casting a product, a measuring unit 12 for reading measured data of the product casted by the die casting machine 30 and the casting condition data when casting this product, an internal memory 13 for accumulating the measured data and the casting data that are transmitted from the measuring unit 12, outputting the measured data combined with good quality product data, setting the accumulated measured data as a new good quality product data in accordance with a good quality product data updating determination input, and updating the present good quality product data together with the casting condition data, a display unit 14 for comparatively displaying the measured data combined with the good quality product data that are outputted from the internal memory 13, a man-machine control unit 15 including a determination input unit 16 for giving the good quality product data updating determination input to the internal memory 13, and a storage unit 20 capable of storing and holding the updated good quality product data together with the casting condition data, and reading these data as the necessity arises.

Given hereinafter is an explanation of an operation of the die casting machine controller according to the present invention, i.e., the method of quality control of the die casting product according to the present invention with reference to FIGS. 1 and 2.

The control unit 11 controls the die casting machine 30 in accordance with a control signal S1 containing the casting condition data for setting a condition on the occasion of casting a product with respect to a die assembly to be used, thereby casting the product.

Measured data consist of casting result data (time series data (e.g., for 10 shots at the maximum) of a velocity, a pressure and a position, etc. when casted)) in which the resultant casting condition is shown by a waveform when casting the product, quality monitoring data (e.g., of approximately 130 items and for 50 shots at the maximum) and cycle data (a predetermined time (e.g., for 50 shots at the maximum) for every casting process). When the product is casted, these measured data together with the casting condition data are transmitted and read as measured data/casting condition data signals S2 to the measuring unit 12 (step S21). The measured data and the casting condition data show a one-to-one correspondence at all times.

The measured data and the casting condition data read by the measuring unit 12, are transmitted as measured data/casting condition data signals S3 to the internal memory 13. The internal memory 13 sequentially accumulates the received measured data/casting condition data D1 up to a predetermined capacity, besides combines the measured data with the already-read good quality product data, transmits the combined data in the form of comparative data signals S4 to the display unit 14, and makes the display unit 14 display a comparison between the measured data and the good quality product data (step S22). Note that the good quality product also, as in the case of the measured data, shows a one-to-one correspondence to the casting condition data when the same good quality product data are obtained.

The comparison between the measured data and the good quality product data is displayed, for instance, in the manner which follows. A "waveform display" is set on a screen of the display unit, and real time waveform data and good quality product waveform data are overlapped with each other and thus displayed, whereby a difference between the real time waveform data and the good quality product waveform data is clearly distinguished at a glance. A "line display" is set on the screen of the display unit, and the digitized real time measured data and good quality product data are so displayed as to be itemized in predetermined forms, whereby the item showing a difference in numerical value is distinguished. A "trend display" is set on the screen of the display unit, and values of the measured data for, e.g., 50 shots are graphed on the basis of the values of the good quality product data, thereby making it feasible to recognize variations with a passage of time in terms of the measured values and differences between the measured values and the good quality product values. As described above, the measured data and the good quality product data are comparatively displayed on the display unit, which makes it possible to recognize a level of quality with respect to the product that is being casted at present and judge its quality. Further, a "quality judgement/good quality product data updating display" for an exclusive use of the quality judgement and updating of the good quality product data, is also set separately from the above-mentioned display screens in order to judge the quality or update the good quality product data which will be mentioned later on.

If the comparatively-displayed measured data are not higher in quality than the present good quality product data, the above steps are sequentially repeated. Whereas if the comparatively displayed measured data are higher in quality than the present good quality product data, the above steps are sequentially repeated, and, while on the other hand, the internal memory 13 is supplied with a good quality product data updating determination input S5 for updating the good quality product data through an input from a determination input unit of the man-machine control unit (step S23). this good quality product data updating determination input is executed normally by an operator who monitors the display unit 14. However, the real time measured data and the good quality product data are always monitored by the man-machine control unit 15, and a good quality product data updating determination condition is previously set in the man-machine control unit 15, wherein if this condition is met, the good quality product data updating determination in put may be automatically implemented. Alternatively, a data processor is added to the internal memory 13, and the good quality product data updating determination condition is preset in the data processor, wherein if this condition is met, the good quality product data may be automatically updated.

The internal memory 13 sets the measured data D1 accumulated corresponding to the good quality product data updating determination input S5 as a new good quality product data, and updates the present good quality product data D2 together with the casting condition data (step S24). The updated good quality product data/casting condition data D2 are held in the internal memory 13.

On the other hand, the updated good quality product data/casting condition data D2 are transmitted as good quality product data/casting condition data signal S6 to the storage unit 20 and storage-held therein (step S25). On this occasion, the good quality product data/casting condition data stored and held in the past are storage-held as they are. For example, 64 data at the maximum are storage-held and kept in a readable status. The storage unit 20 may involve an adequately selected use of a floppy disk and a floppy disk drive, a hard disk and a hard disk drive, and other storage mediums and storage devices.

The good quality product data/casting condition data D2 stored and held in the storage unit 20 are thereafter read out to the internal memory 13 at any time according to the necessity, and transmitted to the control unit as, e.g., good quality product data/casting condition data signals S7, wherein the data D2 are used for casting a higher quality product (step S26).

What is claimed is:

1. A method of quality control of a die casting product, comprising:

controlling a die casting machine with a control signal (i) containing casting condition data connected with a die assembly to be used (ii) and for setting a condition to cast the product, and casting the product;

reading in (i) to a die casting controller measured data obtained as a result of a predetermined measurement with respect to the product cast by said die assembly and (ii) the casting condition data;

sequentially accumulating in the die casting controller the read measured data and casting condition data up to a predetermined capacity, comparing the measured data combined with previous good quality product data to be used for judging a quality of the product, and comparatively displaying results of the comparison;

(i) setting the accumulated measured data as new good quality product data (ii) updating the previous good quality product data with the casting condition data in real-time, and (iii) displaying the new good quality product data and the updated previous good quality data separate from the comparatively displayed comparison results if the comparatively displayed measured data are higher in quality than the previous good quality product data, repeating said controlling, reading, and said sequentially accumulating if the comparatively displayed measured data are not higher in quality than the existing good quality condition data;

storing and holding the updated good quality product data and the updated casting condition data in a storage unit; and reading out said stored and held updated good quality product data and the updated casting condition data as necessity arises, and using these data for controlling said die casting machine.

* * * * *